US008142210B2

(12) United States Patent
Gao et al.

(10) Patent No.: US 8,142,210 B2
(45) Date of Patent: Mar. 27, 2012

(54) DATA CARD WITH ROTATABLE CONNECTOR AND ROTATABLE CONNECTOR FOR DATA CARD

(75) Inventors: Chunyu Gao, Shenzhen (CN); Menglong Zhao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 12/955,315

(22) Filed: Nov. 29, 2010

(65) Prior Publication Data

US 2011/0130018 A1 Jun. 2, 2011

(30) Foreign Application Priority Data

Nov. 30, 2009 (CN) ..... 2009 2 0272020 U

(51) Int. Cl.
*H01R 13/44* (2006.01)

(52) U.S. Cl. ..... 439/131; 439/136

(58) Field of Classification Search ..... 439/131, 439/13, 460, 136
See application file for complete search history.

(56) References Cited

U.S. PATENT DOCUMENTS

| | | | | |
|---|---|---|---|---|
| 5,637,018 | A * | 6/1997 | Gargiulo | 439/640 |
| 5,658,157 | A * | 8/1997 | Koiwa et al. | 439/165 |
| 6,544,075 | B1 | 4/2003 | Liao | |
| 7,347,736 | B2 * | 3/2008 | Ni | 439/660 |
| 7,357,654 | B2 * | 4/2008 | Lin et al. | 439/164 |
| 7,530,823 | B1 | 5/2009 | Thornton et al. | |
| 7,586,460 | B2 * | 9/2009 | Hunt et al. | 343/882 |
| D606,078 | S * | 12/2009 | Chen | D14/480.6 |
| 7,632,113 | B2 * | 12/2009 | Finn | 439/131 |
| 7,736,189 | B2 * | 6/2010 | Chan et al. | 439/640 |
| 7,920,386 | B2 * | 4/2011 | Tsao et al. | 361/755 |
| 2007/0105418 | A1 | 5/2007 | Fu et al. | |
| 2008/0026614 | A1 * | 1/2008 | Emerson et al. | 439/136 |
| 2008/0276099 | A1 * | 11/2008 | Nguyen et al. | 713/186 |
| 2009/0023335 | A1 * | 1/2009 | Su et al. | 439/607 |

(Continued)

FOREIGN PATENT DOCUMENTS

| | | |
|---|---|---|
| CN | 2717044 | 8/2005 |

(Continued)

OTHER PUBLICATIONS

Extended European Search Report, mailed Mar. 8, 2011, in corresponding European Application No. 10192944.6 (8 pp.).

*Primary Examiner* — Briggitte R Hammond
(74) *Attorney, Agent, or Firm* — Staas & Halsey LLP

(57) ABSTRACT

In the field of data cards with a rotatable external port, a data card with a rotatable connector and a rotatable connector for a data card are provided. The data card with a rotatable connector includes a data card body and a rotatable connector, where the rotatable connector includes an external port for connecting with an external device, and the rotatable connector is rotatably connected with the data card body. The data card further includes an antenna set in the rotatable connector. The rotatable connector for a data card includes a rotatable connector body and an external port for connecting with an external device, and includes an antenna therein. Through setting the antenna in the rotatable connector, no matter what angle the data card is rotated, the antenna is always maintained in the same state, so that the antenna can be modulated in advance, so as to eliminate the interference on the performance of the antenna caused by the external device, and ensures stable performance of the antenna.

9 Claims, 7 Drawing Sheets

U.S. PATENT DOCUMENTS

| | | | | |
|---|---|---|---|---|
| 2009/0096681 | A1 | 4/2009 | Hunt et al. | |
| 2010/0075517 | A1 * | 3/2010 | Ni et al. | 439/131 |

FOREIGN PATENT DOCUMENTS

| | | |
|---|---|---|
| CN | 101378266 | 3/2009 |
| CN | 201204050 | 3/2009 |
| EP | 0710059 | 5/1996 |
| EP | 2088484 | 8/2009 |
| EP | 2124297 | 11/2009 |
| JP | 2000292522 | 10/2000 |
| JP | 2004-227277 | 8/2004 |
| WO | WO 2010/065891 | 6/2010 |

* cited by examiner

DATA CARD WITH ROTATABLE CONNECTOR AND ROTATABLE CONNECTOR FOR DATA CARD

CROSS-REFERENCE TO RELATED APPLICATIONS

This application claims priority to Chinese Patent Application No. 200920272020.9, filed on Nov. 30, 2009, and International Patent Application No. PCT/CN2010/076426, filed on Aug. 27, 2010, both of which are hereby incorporated by reference in their entireties.

FIELD OF THE TECHNOLOGY

The present invention relates to a data card in the field of communications, and more particularly to a data card with a rotatable connector and a rotatable connector for a data card.

BACKGROUND OF THE INVENTION

An data card (also called a wireless modem or broadband network card) is set with an antenna built therein, and is connected with an external device or other devices through an external port, so as to enable the external device or other devices to be connected with a wireless network through the antenna of the data card.

The existing data card generally has a structure as shown in FIGS. 1, 2, and 3 for ease of carrying, that is, the data card includes a data card body 1 and a rotatable connector 2 capable of rotating relative to the data card body, where the rotatable connector 2 includes an external port 3 thereon. As shown in FIG. 1, the rotatable connector 2 of the existing data card is capable of rotating to three positions as shown by dotted lines relative to the data card body 1. Thus, the user can rotate the rotatable connector 2 to a certain angle as requires, so as to connect the data card with an external device through the external port 3. When the data card is not in use, the user can rotate the rotatable connector 2 into a reserved space in the data card body 1.

As shown in FIG. 2, when the external port 3 is rotated 90° or 270° (not shown in the Figure), the data card is parallel to a surface of the external device after the data card is inserted into the external device. As shown in FIG. 3, when the external port 3 is rotated 180°, the data card body 1 is perpendicular to the surface of the external device after the data card is inserted into the external device. When the external port 3 is rotated 90° or 270°, the data card will occupy minimal space around the external device, which provides convenience to the user, and meanwhile, the data card is also protected when being used in this manner.

In the implementation of the present invention, the inventor found that the prior art has at least the following problems.

As shown in FIG. 4, in the existing data card with a rotatable connector, the antenna 4 is designed at a tail portion of the data card body 1. Thus, when the data card is used in the manner as shown in FIG. 3, that is, when the data card body 1 is perpendicular to the surface of the external device, the distance between the antenna 4 and the external device is maximum, and the antenna 4 is not affected. However, when the data card is used in the manner as shown in FIG. 2, that is, when the external port 3 of the rotatable connector 2 is rotated 90° or 270°, and the data card body 1 is parallel to the surface of the external device, the data card body 1 is close to the surface of the external device, the performance of the antenna 4 is greatly affected, and at this time, the performance of the antenna 4 deteriorates sharply. Therefore, when the user uses the data card at different angles, the performance of the antenna 4 is not stable, which affects the use.

SUMMARY OF THE INVENTION

In order to solve the problem in the prior art that the performance of the antenna is not stable which affects the use when the existing data card with a rotatable connector is used, the present invention is directed to a data card with a rotatable connector and a rotatable connector for a data card. The technical solutions are as follows.

The present invention provides a data card with a rotatable connector, which includes a data card body and a rotatable connector. The rotatable connector includes an external port for connecting with an external device. The rotatable connector is rotatably connected with the data card body. The data card further includes an antenna set in the rotatable connector.

Meanwhile, the present invention also provides a rotatable connector for a data card, which includes a rotatable connector body and an external port for connecting with an external device, where the rotatable connector further includes an antenna set in the rotatable connector body.

The technical solutions of the present invention have the following beneficial effects, According to the present invention, through setting the antenna in the rotatable connector, no matter what angle the data card body of the data card is rotated, the distance between the antenna and an edge of the external device and the relative position of the antenna to the edge of the external device are not changed, and thus the antenna is maintained in the same state. In this way, the distance between the antenna and the external device is fixed, and only the relative position of the data card body to the external device is changed. Thus, the performance of the antenna can be modulated in advance, so as to eliminate the interference on the performance of the antenna caused by the external device. Meanwhile, since the antenna is placed in the rotatable connector, the available space of the rotatable connector is much larger than the space occupied by the antenna when being placed at the tail portion, which is quite beneficial to the performance of the antenna. Moreover, since the antenna is moved from the tail portion to the rotatable connector, the antenna does not need to occupy the space of the data card body, the length of the data card is greatly reduced, and thus the overall size of the data card is further reduced.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

In order to make the objectives, technical solutions, and advantages of the present invention more comprehensible, the present invention is described in further detail below with reference to embodiments and the accompanying drawings.

Figure 1:
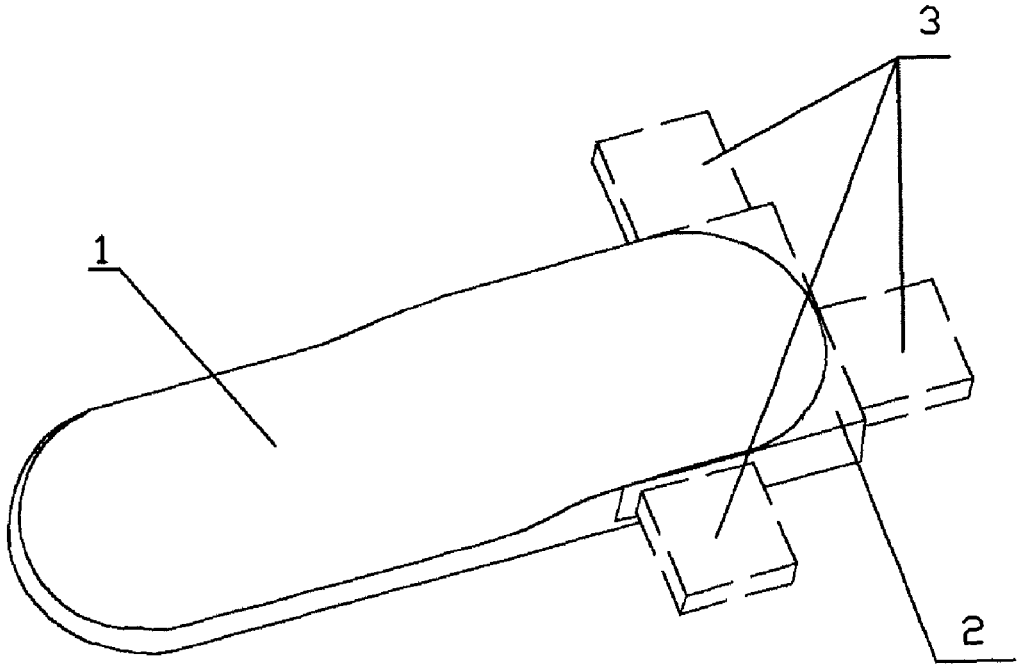
FIG. 1 (Prior Art)
FIG. 1 is a schematic structural view of an existing data card with a rotatable connector.
Figure 2:
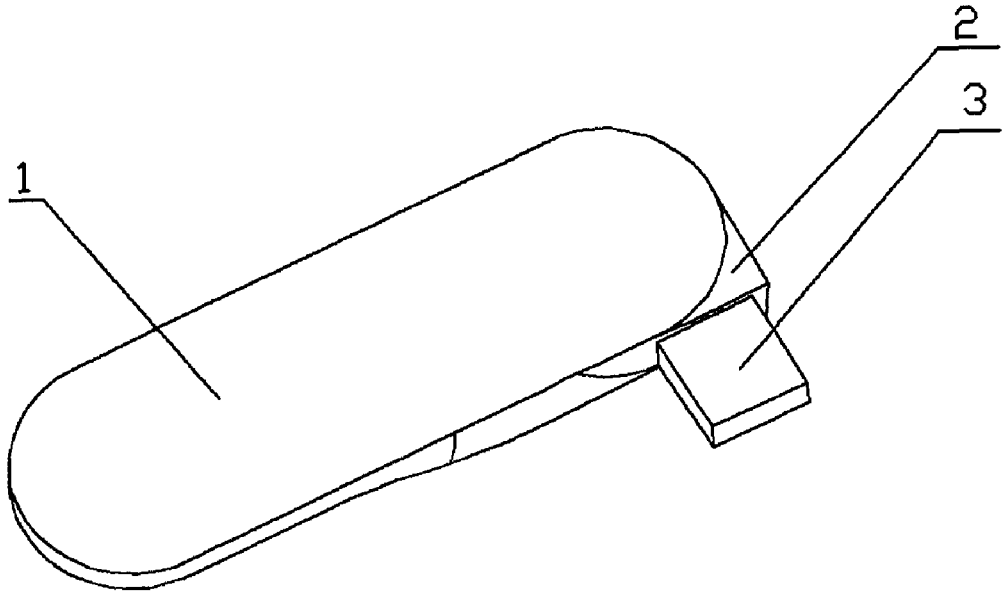
FIG. 2 (Prior Art)
FIG. 2 is a schematic structural view of the data card with a rotatable connector in FIG. 1 when an external port is rotated 90°.
Figure 3:
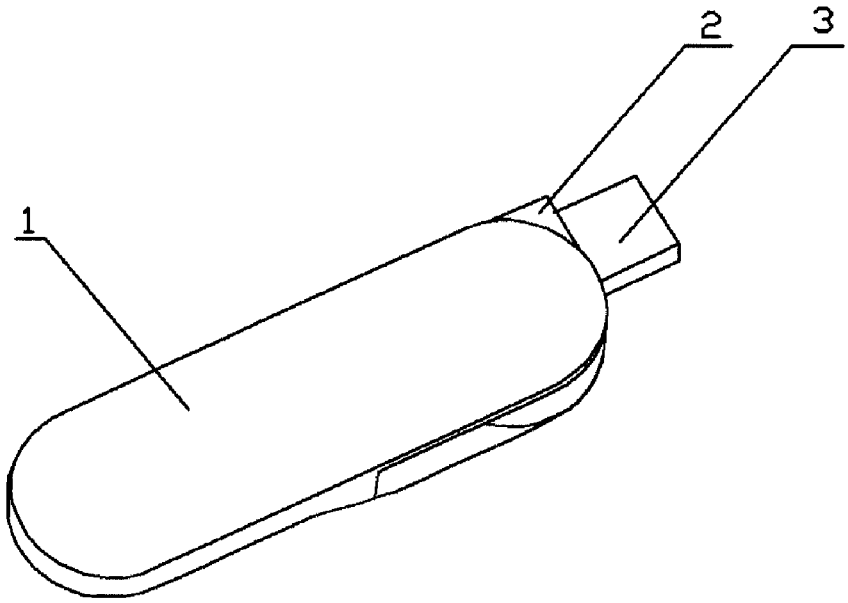
FIG. 3 (Prior Art)
FIG. 3 is a schematic structural view of the data card with a rotatable connector in FIG. 1 when the external port is rotated 180°.
Figure 4:
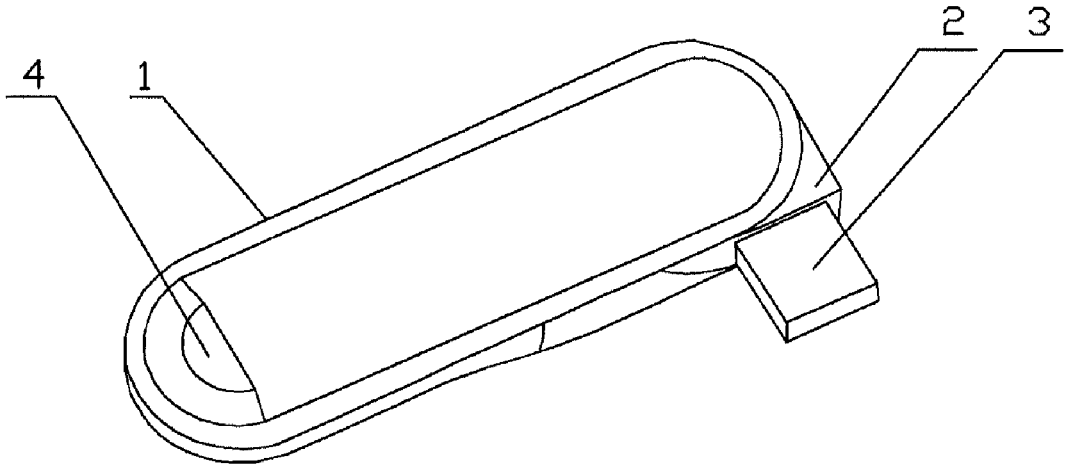
FIG. 4 (Prior Art)
FIG. 4 is a schematic view of an internal structure of the data card with a rotatable connector in FIG. 1.
Figure 5:
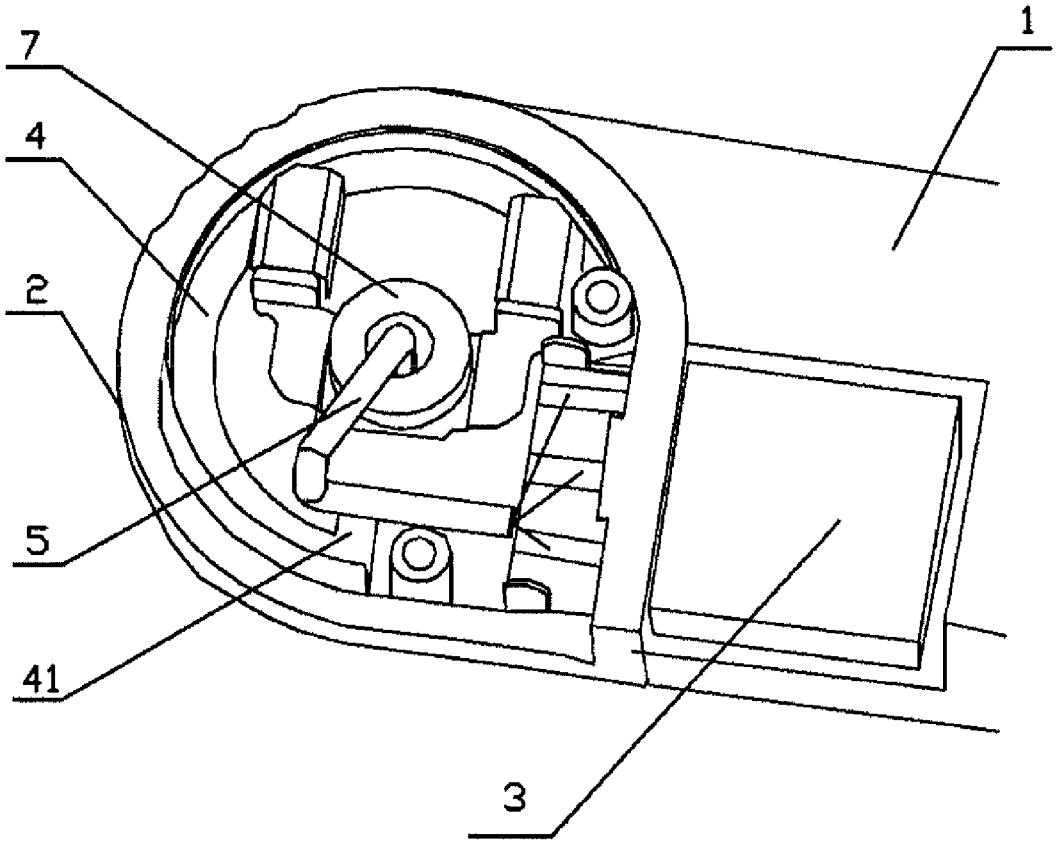
FIG. 5 is a schematic view of a preferred internal structure of a data card with a rotatable connector according to the present invention.
Figure 6:
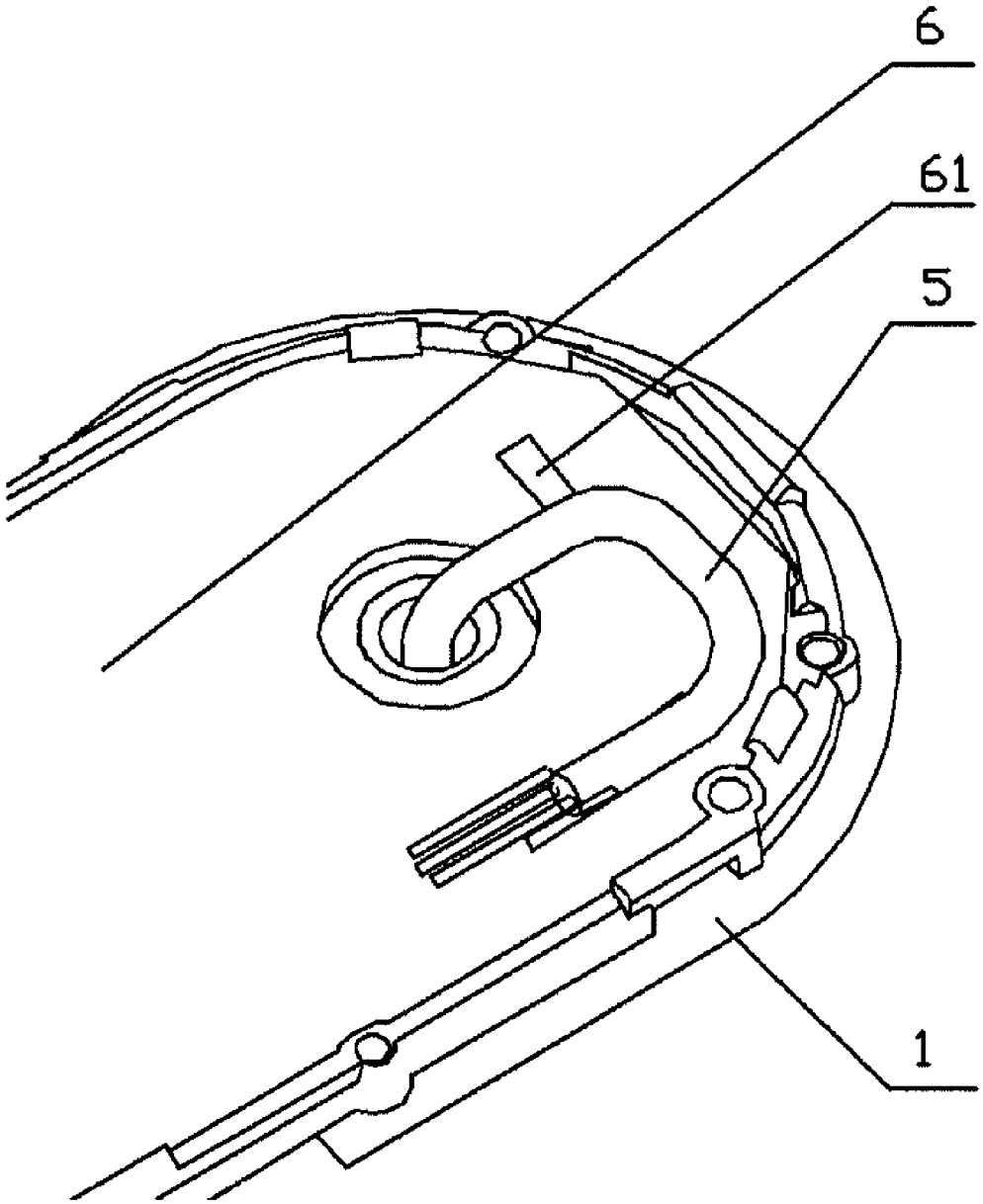
FIG. 6 is a schematic back view of the internal structure of FIG. 5.
Figure 7:
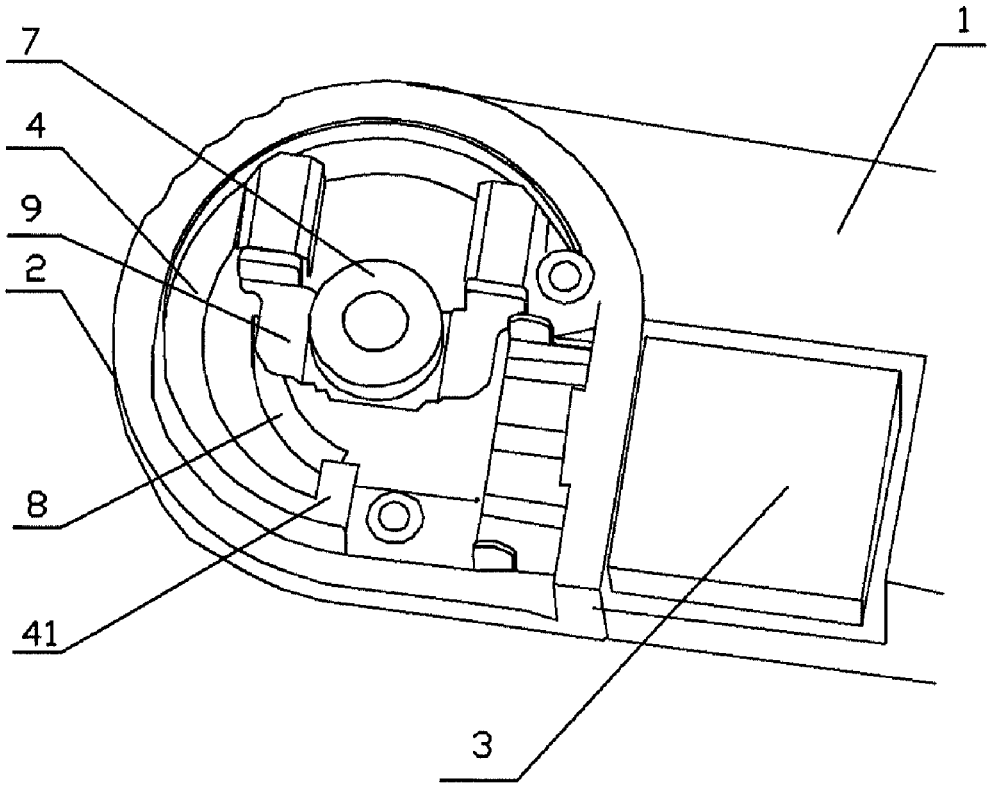
FIG. 7 is a schematic view of another preferred internal structure of the data card with a rotatable connector according to the present invention.

In a preferred embodiment, the present invention provides a data card with a rotatable connector, of which a structure is shown in FIGS. 5, 6, and 7, and the data card includes a data card body 1 and a rotatable connector 2. The rotatable connector 2 includes an external port 3 for connecting with an external device. The rotatable connector 2 is rotatably connected with the data card body 1. The data card further includes an antenna 4 which is set in the rotatable connector 2.

In the preferred embodiment of the present invention, the antenna 4 is set in the rotatable connector 2. In this way, no matter what angle the data card body is rotated, the distance between the antenna 4 and an edge of the external device and the relative position of the antenna 4 to the edge of the external device are not changed, and only the relative position of the data card body 1 to the external device are changed. Thus, the antenna 4 remains in the same state, and the performance of the antenna 4 is stable and will not be changed due to interference caused by the external device. Meanwhile, since the antenna 4 is placed in the rotatable connector 2, the available space of the rotatable connector is much larger than the space occupied by the antenna 4 when being placed at the tail portion, which is quite beneficial to the performance of the antenna 4. Moreover, since the antenna 4 is moved from the tail portion to the rotatable connector 2, the length of the data card is greatly reduced, and the overall size of the data card is further reduced.

Preferably, as shown in FIGS. 5, 6, and 7, the data card further includes a circuit 6, set in the data card body 1, electrically connected with the antenna 4 through a connection mechanism, and electrically connected with the external port 3. The circuit 6 may be specifically a circuit in the form of a printed circuit board (PCB) or a circuit in other forms.

In the preferred embodiment of the present invention, the circuit 6 of the data card is set in the data card body 1, and then electrically connected with the antenna 4 through a connection mechanism, so that the volume of the rotatable connector 2 is reduced, and this facilitates rotation of the rotatable connector 2. Definitely, the circuit 6 may also be set at other positions, and the preferred embodiment of the present invention is not limited thereto.

Preferably, the connection mechanism may be a cable 5. The structure of this embodiment may be as shown in FIG. 5: the rotatable connector 2 is rotatably connected with the data card body 1 through a rotary shaft 7, the connection mechanism is a cable 5, there is an axially formed through hole in the rotary shaft 7, and the cable 5 is set in the through hole. As shown in FIG. 5, there is a connection feed point 41 on the antenna 4, and one end of the cable 5 is electrically connected with the connection feed point 41. The position of the connection feed point 41 may be selected according to the requirements, which is not limited in the present invention. As shown in FIG. 6, the other end of the cable 5 is electrically connected to an antenna feed point 61 of the circuit 6.

By adopting the above mentioned structure of FIG. 5 and FIG. 6, the circuit 6 set in the data card body 1 can be stably electrically connected with the antenna 4 set in the rotatable connector 2 and the external port 3, so that the circuit 6 is connected to a wireless network through the antenna 4 for data transmission, and to the external device through the external port 3 for data transmission without affecting the rotation of the rotatable connector 2.

Preferably, as shown in FIG. 7, the connection mechanism may also be an electric conductor (for example, a metal elastic sheet 8 or a conducting wire) and a metal rotary shaft bracket 9. The electric conductor is configured to electrically connect the antenna 4 and the metal rotary shaft bracket 9. Definitely, the metal rotary shaft bracket 9 may also be directly electrically connected with the antenna 4 without using the electric conductor. The metal rotary shaft bracket 9 is set in and fixed relative to the rotatable connector 2, and the metal rotary shaft bracket 9 may be fixedly set on the rotatable connector 2 or fixedly set on other parts mounted on the rotatable connector 2. The rotary shaft 7 is fixed relative to the data card body 1. The metal rotary shaft bracket 9 is movable relative to the rotary shaft 7, that is, the rotary shaft 7 can rotate in the metal rotary shaft bracket 9, so as to enable the rotatable connector 2 to rotate relative to the data card body 1. The structure of this embodiment may be as shown in FIG. 7: the rotatable connector 2 is rotatably connected with data card body 1 through the rotary shaft 7; the connection mechanism is a metal elastic sheet 8 and a metal rotary shaft bracket 9, the metal elastic sheet 8 is set in the rotatable connector 2, there is a connection feed point 41 on the antenna 4, and the connection feed point 41 is electrically connected with the metal elastic sheet 8; and the rotary shaft 7 is a metal rotary shaft, the metal rotary shaft is electrically connected with the metal rotary shaft bracket 9, the metal rotary shaft is fixed relative to the data card body 1, and the metal rotary shaft is electrically connected with the circuit 6 in the data card body 1. Thus, the circuit 6 is electrically connected with the rotary shaft 7, the rotary shaft 7 is electrically connected with the metal rotary shaft bracket 9, and the metal rotary shaft bracket 9 is electrically connected with the antenna 4, so that the connection feed point 41 of the antenna 4 and the antenna feed point of the circuit 6 are electrically connected. An electrically conductive elastic sheet or an electrically conductive spring may be set on the metal rotary shaft bracket 9. The electrically conductive elastic sheet or the electrically conductive spring contacts the metal rotary shaft 7, so as to electrically connect the metal rotary shaft 7 and the metal rotary shaft bracket 9. As an option, the electrically conductive elastic sheet or the electrically conductive spring may be set on the metal rotary shaft 7 so as to electrically connect the metal rotary shaft 7 and the metal rotary shaft bracket 9.

With the above mentioned structure in FIG. 7, the circuit 6 set in the data card body 1 can be stably electrically connected with the antenna 4 set in the rotatable connector 2 and the external port 3, so that the circuit 6 is connected to a wireless network through the antenna 4 for data transmission, and to the external device through the external port 3 for data transmission without affecting the rotation of the rotatable connector 2. The connection feed point 41 of the antenna 4 is conducted with the metal rotary shaft bracket 9, the metal rotary shaft bracket 9 is electrically connected with the rotary shaft 7, and the rotary shaft 7 is directly connected with or fixed to the antenna feed point 61 of the circuit 6. In this way, and the connection between the antenna 4 and the circuit 6 is achieved.

Definitely, persons of ordinary skill in the art should understand that, the connection mechanism is not limited to the connection mode using the cable and the connection mode using the metal elastic sheet and the metal rotary shaft bracket. The two connection modes are illustrated by way of example only, and the protection scope of the present invention is not limited thereto. The circuit 6 may be connected with the antenna 4 and the external port 3 through different connection modes.

Preferably, as shown in FIGS. 5 and 7, the antenna is fixed in the rotatable connector, and extends along an inner wall of the rotatable connector. As shown in FIGS. 5 and 7, the inner wall of the rotatable connector 2 may be arc-shaped, and the antenna 4 may also be designed to be arc-shaped, and fit the inner wall of the rotatable connector 2. Definitely, the shape of the cavity of the rotatable connector may be designed at will as requires, so that the shape of the antenna may also be changed with the shape of the inner wall of the cavity. Preferably, the antenna 4 includes an arc-shaped bottom and a side wall perpendicular to the arc-shaped bottom, the antenna 4 is fixed to and fits the inner wall of the rotatable connector, and the connection feed point 41 is a bump on the arc-shaped bottom.

With the above mentioned structure of FIGS. 5 and 7, the length of the antenna 4 can be increased as much as possible without changing the volume and shape of the rotatable connector 2, and the antenna 4 can be stably buckled on the inner wall of the rotatable connector 2, and thus the stability of the connection is improved.

Figure 8:
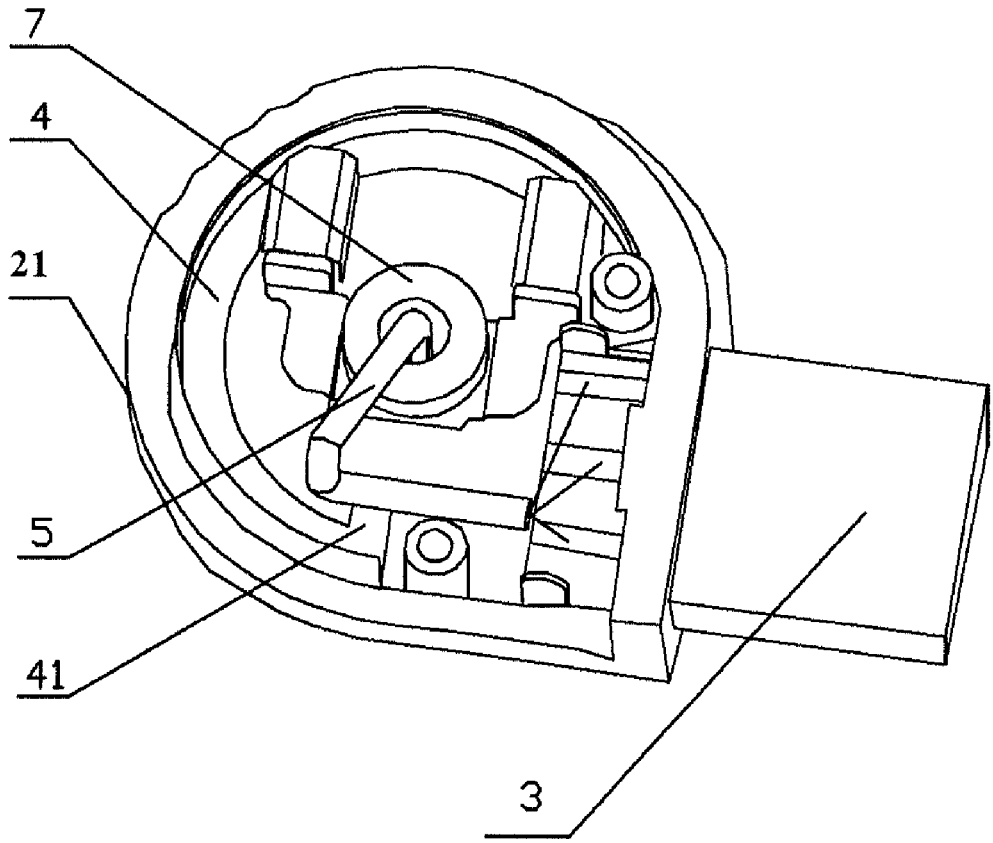
FIG. 8 is a schematic view of a preferred internal structure of a rotatable connector for a data card according to the present invention.
Figure 9:
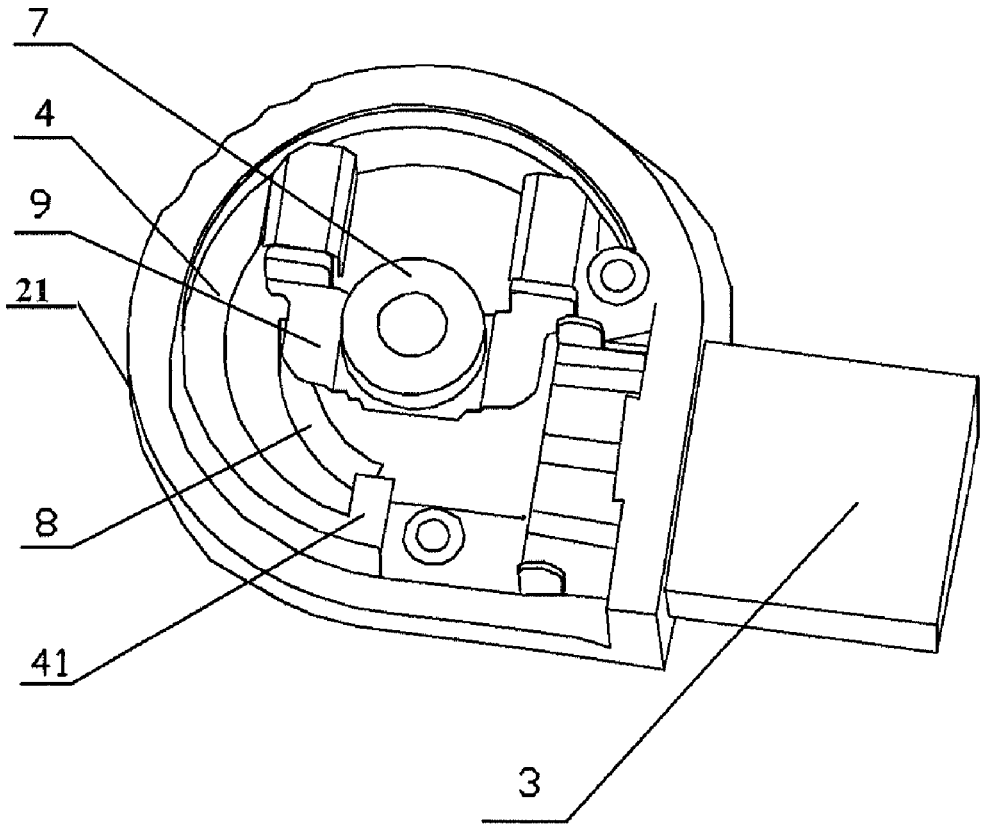
FIG. 9 is a schematic view of another preferred internal structure of the rotatable connector for a data card according to the present invention.

In another preferred embodiment, the present invention further provides a rotatable connector for a data card, of which a structure is shown in FIGS. 8 and 9, and includes a rotatable connector body 21 and an external port 3 for connecting with an external device. There is an antenna 4 set in the rotatable connector body 21.

In the preferred embodiment of the present invention, the antenna 4 is set in the rotatable connector body 21. The data card using such a rotatable connector includes a data card body 1 connected with the rotatable connector, as shown in FIGS. 5, 6, and 7. No matter what angle the data card body 1 is rotated, the distance between the antenna 4 to an edge of the external device and the relative position of the antenna 4 to the edge of the external device are not changed, and only the relative position of the data card body 1 to the external device are changed. Thus, the antenna 4 is maintained in the same state, and the performance of the antenna 4 is stable and will not be changed due to interference caused by the external device. Meanwhile, since the antenna 4 is placed in the rotatable connector body 21, the available space of the rotatable connector body is much larger than the space occupied by the antenna 4 when being placed at the tail portion, which is quite beneficial to the performance of the antenna 4. Moreover, since the antenna 4 is moved from the tail portion to the rotatable connector, a large keep-out area in front of a circuit 6 of the data card is effectively utilized, and the length of the data card is greatly reduced, so that the overall size of the data card is further reduced.

Preferably, as shown in FIGS. 8 and 9, the rotatable connector further includes a connection mechanism, and the antenna 4 is electrically connected with the connection mechanism.

The rotatable connector of this embodiment is an part of the data card, and the data card with the rotatable connector includes a data card body 1 connected with the rotatable connector 2, as shown in FIGS. 5, 6, and 7. There is a circuit 6 set in the data card body 1. The circuit 6 is respectively electrically connected with the antenna 4 and the external port 3 through a connection mechanism.

Preferably, the connection mechanism may be a cable 5. The structure of this embodiment may be as shown in FIG. 8: the rotatable connector is connected with a rotary shaft 7; the connection mechanism is a cable 5, there is an axially formed through hole in the rotary shaft 7, and the cable 5 is set in the through hole. There is a connection feed point 41 on the antenna 4, and one end of the cable 5 is electrically connected with the connection feed point 41. The position of the connection feed point 41 may be selected according to the requirements, which is not limited in the present invention.

When the rotatable connector with the above mentioned structure of FIG. 8 is connected with the data card body 1, the circuit 6 set in the data card body 1 can be stably electrically connected with the antenna 4 set in the rotatable connector and the external port 3, so that the circuit 6 is connected to a wireless network through the antenna 4 for data transmission, and to the external device through the external port 3 for data transmission without affecting the rotation of the rotatable connector. Meanwhile, referring to FIG. 6, there is a circuit 6 in the data card body 1 used in combination with the rotatable connector 2 of this embodiment, and the other end of the cable 5 is electrically connected with an antenna feed point 61 of the circuit 6.

Preferably, the connection mechanism may also be an electric conductor (for example, a metal elastic sheet 8 or a conducting wire) and a metal rotary shaft bracket 9. The electric conductor is configured to electrically connect the antenna 4 and the metal rotary shaft bracket 9. Definitely, the metal rotary shaft bracket 9 may also be directly electrically connected with the antenna 4 without using the electric conductor. The metal rotary shaft bracket 9 is set in and fixed relative to the rotatable connector, and the metal rotary shaft bracket 9 may be fixedly set on the rotatable connector body 21 or fixedly set on other parts mounted on the rotatable connector body 21. The rotary shaft 7 is fixed relative to the data card body 1. The metal rotary shaft bracket 9 is movable relative to the rotary shaft 7, that is, the rotary shaft 7 can rotate in the metal rotary shaft bracket 9, so as to enable the rotatable connector to rotate relative to the data card body 1. The structure of this embodiment may be as shown in FIG. 9: the rotatable connector body 21 is connected with a rotary shaft 7; and the connection mechanism is a metal elastic sheet 8 and a metal rotary shaft bracket 9, and the metal elastic sheet 8 is set in the rotatable connector body 21. There is a connection feed point 41 on the antenna 4, and the connection feed point 41 is electrically connected with the metal elastic sheet 8. The metal rotary shaft bracket 9 electrically connected with the metal elastic sheet 8. The rotary shaft 7 is a metal rotary shaft, and the metal rotary shaft is electrically connected with the metal rotary shaft bracket 9. For example, an electrically conductive elastic sheet or an electrically conductive spring may be set on the metal rotary shaft bracket 9 and the electrically conductive elastic sheet or the electrically conductive spring contacts the metal rotary shaft 7, so as to electrically connect the metal rotary shaft 7 and the metal rotary shaft bracket 9. As an option, the electrically conductive elastic sheet or the electrically conductive spring may be set on the metal rotary shaft 7 so as to electrically connect the metal rotary shaft 7 and the metal rotary shaft bracket 9.

When the rotatable connector with the above mentioned structure of FIG. 9 is connected with the data card body 1, the circuit 6 set in the data card body 1 can be stably electrically connected with the antenna 4 set in the rotatable connector body 21 and the external port 3, so that the circuit 6 is connected to a wireless network through the antenna 4 for data transmission, and to the external device through the external port 3 for data transmission without affecting the rotation of the rotatable connector. There is a circuit 6 in the data card body 1 used in combination with the rotatable connector of this embodiment. The rotary shaft 7 is a metal rotary shaft, the metal rotary shaft is fixed relative to the data card body 1, and the metal rotary shaft is electrically connected with the circuit 6 in the data card body 1. Thus, the circuit 6 is electrically connected with the rotary shaft 7, the rotary shaft 7 is electrically connected with the metal rotary shaft bracket 9, and the metal rotary shaft bracket 9 is electrically connected with the antenna 4, so that the connection feed point of the antenna 4 and the antenna feed point of the circuit 6 are electrically connected.

Definitely, persons of ordinary skill in the art should understand that, the connection mechanism is not limited to the connection mode using the cable and the connection mode using the metal elastic sheet and the metal rotary shaft bracket. The two connection modes are illustrated by way of example only, and the protection scope of the present invention is not limited thereto. The external port 3 may be electrically connected with circuit 6 through any mode.

Preferably, as shown in FIGS. 8 and 9, the antenna is fixed in the rotatable connector body 21, and extends along an inner wall of the rotatable connector body 21. As shown in FIGS. 8 and 9, the inner wall of the rotatable connector body 21 may be arc-shaped, and the antenna 4 may also be designed to be arc-shaped, and fit the inner wall of the rotatable connector body 21. Definitely, the shape of the cavity of the rotatable connector body 21 may be designed at will as requires, so that the shape of the antenna may also be changed with the shape of the inner wall of the cavity. Preferably, the antenna 4 includes an arc-shaped bottom and a side wall perpendicular to the arc-shaped bottom, the antenna 4 is fixed to and fits the inner wall of the rotatable connector body 21, and the connection feed point 41 is a bump on the arc-shaped bottom.

With the above mentioned structure of FIGS. 8 and 9, the length of the antenna 4 can be increased as much as possible without changing the volume and shape of the rotatable connector, and the antenna 4 can be stably buckled on the inner wall of the rotatable connector body 21, thus improving the stability of the connection.

In the embodiments described above, the external port includes, but is not limited to, a universal serial bus (USB) port; the external device includes, but is not limited to, a computer; and the circuit includes, but is not limited to, a printed circuit board (PCB).

It can be seen from the embodiments that, in the preferred embodiments of the present invention, through setting the antenna in the rotatable connector, no matter what angle the data card body of the data card is rotated, the distance and relative position of the antenna to the edge of the external device are not changed, and the antenna is maintained in the same state, so that the distance between the antenna and the external device is fixed, and only the relative position of the data card body to the external device are changed. Thus, the performance of the antenna can be modulated in advance, so as to eliminate the interference of the external device on the performance of the antenna. Meanwhile, since the antenna is placed in the rotatable connector, the available space of the rotatable connector is much larger than the space occupied by the antenna when being placed at the tail portion, which is quite beneficial to the performance of the antenna. Moreover, since the antenna is moved from the tail portion to the rotatable connector, the length of the data card is greatly reduced, so that the overall size of the data card is further reduced.

The above descriptions are merely some exemplary embodiments of the present invention, but not intended to limit the present invention. Any modification, equivalent replacement, or improvement made without departing from the spirit and principle of the present invention should fall within the scope of the present invention.

What is claimed is:

1. A data card with a rotatable connector, comprising a data card body, a rotatable connector, an antenna and a circuit, wherein:

the rotatable connector comprises an external port for connecting with an external device, the rotatable connector is rotatably connected with the data card body, the antenna is set in the rotatable connector, and the circuit is set in the data card body, electrically connected with the antenna through a connection mechanism, and electrically connected with the external port.

2. The data card according to claim 1, wherein:

the rotatable connector is rotatably connected with the data card body through a rotary shaft where there is an axially formed through hole, the connection mechanism is a cable, which is set in the through hole, a connection feed point exists on the antenna, and one end of the cable is electrically connected with the connection feed point of the antenna, and the other end of the cable is electrically connected with the circuit in the data card body.

3. The data card according to claim 1, wherein:

the rotatable connector is rotatably connected with the data card body through a rotary shaft which is metallic and fixed relative to the data card body, the connection mechanism is a metal rotary shaft bracket which is set in the rotatable connector and fixed relative to the rotatable connector, there is a connection feed point, which is electrically connected with the metal rotary shaft bracket, on the antenna, the metal rotary shaft bracket is electrically connected with the rotary shaft, and the rotary shaft is electrically connected with the circuit in the data card body.

4. The data card according to claim 1, wherein the antenna is fixed in the rotatable connector, and extends along an inner wall of the rotatable connector.

5. The data card according to claim 4, wherein:

the antenna comprises an arc-shaped bottom and a side wall, and the antenna is fixed to and fits the inner wall of the rotatable connector.

6. A rotatable connector for a data card, comprising a rotatable connector body, a connection mechanism and an external port for connecting with an external device, wherein the rotatable connector further comprises an antenna, the antenna is set in the rotatable connector body and the antenna is electrically connected with the connection mechanism, and wherein:

the rotatable connector is connected with a rotary shaft where there is an axially formed through hole, the connection mechanism is a cable, which is set in the through hole, and a connection feed point, which is electrically connected with one end of the cable, exists on the antenna.

7. A rotatable connector for a data card, comprising a rotatable connector body, a connection mechanism and an external port for connecting with an external device, wherein the rotatable connector further comprises an antenna, the antenna is set in the rotatable connector body and the antenna is electrically connected with the connection mechanism, and wherein:

the rotatable connector is configured to rotatably connect with the data card body through a rotary shaft which is metallic and fixed relative to the data card body, the connection mechanism is a metal rotary shaft bracket which is set in the rotatable connector body and fixed relative to the rotatable connector, a connection feed point, which is electrically connected with the metal rotary shaft bracket, exists on the antenna, and the metal rotary shaft bracket is electrically connected with the rotary shaft.

8. A rotatable connector for a data card, comprising a rotatable connector body, a connection mechanism and an external port for connecting with an external device, wherein the rotatable connector further comprises an antenna, the antenna is set in the rotatable connector body and the antenna is electrically connected with the connection mechanism, and wherein the antenna is fixed in the rotatable connector body, and extends along an inner wall of the rotatable connector body.

9. The rotatable connector for a data card according to claim 8, wherein:

the antenna comprises an arc-shaped bottom and a side wall, and the antenna is fixed to and fits the inner wall of the rotatable connector body.

* * * * *

UNITED STATES PATENT AND TRADEMARK OFFICE

CERTIFICATE OF CORRECTION

PATENT NO. : 8,142,210 B2
APPLICATION NO. : 12/955315
DATED : March 27, 2012
INVENTOR(S) : Chunyu Gao et al.

It is certified that error appears in the above-identified patent and that said Letters Patent is hereby corrected as shown below:

On the Cover Page, in Item (73), delete "Huawei Technologies Co., Ltd." and insert --Huawei Device Co., Ltd.--.

Signed and Sealed this
Twenty-fourth Day of July, 2012

David J. Kappos

David J. Kappos
*Director of the United States Patent and Trademark Office*